US011738377B2

(12) United States Patent
Hollars et al.

(10) Patent No.: US 11,738,377 B2
(45) Date of Patent: Aug. 29, 2023

(54) HAND-HELD DRAIN CLEANER WITH CARTRIDGE HOUSING

(71) Applicants: Anthony Hollars, Tucson, AZ (US); Charles Gallo, Pembroke, VA (US)

(72) Inventors: Anthony Hollars, Tucson, AZ (US); Charles Gallo, Pembroke, VA (US)

( * ) Notice: Subject to any disclaimer, the term of this patent is extended or adjusted under 35 U.S.C. 154(b) by 682 days.

(21) Appl. No.: 16/792,310

(22) Filed: Feb. 17, 2020

(65) Prior Publication Data

US 2020/0261949 A1 Aug. 20, 2020

Related U.S. Application Data

(60) Provisional application No. 62/808,002, filed on Feb. 20, 2019.

(51) Int. Cl.

| | |
|---|---|
| ***B08B 9/032*** | (2006.01) |
| ***E03C 1/304*** | (2006.01) |
| ***B08B 5/02*** | (2006.01) |

(52) U.S. Cl.
CPC ..... *B08B 9/0328* (2013.01); *B08B 5/02* (2013.01); *E03C 1/304* (2013.01)

(58) Field of Classification Search
CPC ..... B08B 2209/032; B08B 9/035; B05B 12/1409; E03C 1/304
See application file for complete search history.

(56) References Cited

U.S. PATENT DOCUMENTS

2011/0225714 A1* 9/2011 Wang ..... B08B 9/0433 4/255.04
2014/0124690 A1* 5/2014 Kihs ..... F16K 3/267 251/320

* cited by examiner

*Primary Examiner* — Lauren A Crane
(74) *Attorney, Agent, or Firm* — Dale F. Regelman

(57) ABSTRACT

A hand-held drain cleaning apparatus which includes a control housing comprising an inlet end and an outlet end, and a cartridge housing having a length. The cartridge housing is releasably attached to the control housing, and the length can be manually adjusted based upon a size of a selected compressed gas cartridge disposed therein.

5 Claims, 6 Drawing Sheets

HAND-HELD DRAIN CLEANER WITH CARTRIDGE HOUSING

CROSS-REFERENCE TO RELATED APPLICATIONS

This Application claims, priority to a U.S. Provisional Patent Application filed on Feb. 20, 2019 and having Ser. No. 62/808,002. This Application further claims priority to a second U.S. Provisional Patent Application filed on Feb. 20, 2019 and having Ser. No. 62/807,997.

FIELD OF THE DISCLOSURE

Disclosed is a portable drain cleaning apparatus that is particularly adapted for use in cleaning condensation drains associated with air conditioning and other refrigeration units, but which could also be used in other plumbing applications.

DESCRIPTION OF THE RELATED ART

Over the years numerous devices have been utilized to clean clogged drains. For example, it has heretofore been known to attach one end of a hose to a sink faucet and to place the other end of the hose, in a generally sealed manner, within a clogged drain in order to cause pressurized water to flow through the hose once the faucet is opened in an attempt to remove any obstructions.

Unfortunately, such a simple arrangement rarely works, even on drains having relatively minor obstructions therein. In an attempt to enhance such a known system, it has also been proposed to place a container housing a drain cleaning fluid in series with the hose in order to introduce an additional cleaning enhancing substance within the clogged drain. This known prior art arrangement generally has associated therewith a level of effectiveness commensurate with simply pouring the cleaning enhancing substance directly down the drain.

Various other drain cleaning devices have also been proposed which incorporate auxiliary pressure sources. For instance, it is known to utilize a miniature gas cartridge in combination with a plunger-type drain cleaning unit to create a high pressure force to dislodge an obstruction within a drain. Actually, standard plunger-type drain cleaning units are essentially just as effective on almost all clogs experienced in these particular types of drains. In addition, such known arrangements are only useful in limited applications due to their size and overall configuration. In essence, these known arrangements are only functional in cleaning standard sink drains and toilets.

One particular environment wherein such prior art arrangements are not functional is in cleaning condensate drains. The main reason why these prior art arrangements are not utilized in connection with condensation drain clogs is the inaccessibility of condensate drains in general. Usually such drains are located in confined areas in attics or basements and the inlet openings thereto are often located directly adjacent a cooling coil or other structure which provides for extremely limited access.

Because of these and other shortcomings of prior known systems, until just recently, the most common method for cleaning condensation drains, particularly in air conditioning or other types of refrigeration units, has been to force a flow of Freon from a pressurized container through the clogged drain. However, with the enactment of regulations by the Environmental Protection Agency (EPA), the use of Freon-based cleaning systems has been made illegal.

In the aftermath of these regulation changes, it became common to simply utilize a rather large, pressurized air or nitrogen tank having an attached hose, the free end of which can be positioned at the opening of a condensate drain conduit such that opening of a valve on the tank will force pressurized gas to be injected into the conduit. However, as indicated above, such drain conduits are often found in confined areas and the lugging of these heavy tanks is not only extremely inconvenient but sometimes dangerous. In addition, it is extremely difficult, if not impossible, to regulate or determine the exact amount of pressurized gas that is released in any given application such that the customer is generally charged for a greater percentage of the pressurized gas than is actually dispensed.

In view of the above, it has also been previously proposed, such as disclosed in U.S. Pat. Nos. 5,803,101 and 5,996,597 which are incorporated herein by reference, to provide a drain cleaning apparatus that is compact and lightweight so as to be readily portable, designed to be easily maneuvered so it can be used in various plumbing environments and particularly in cleaning hard to access condensate drain conduits, which cost effective to make and utilize, and consumer conscious in nature. Still, there exists a need in the art for improvements to, such known portable drain cleaning apparatuses. In particular, there exists a need to provide a very compact, single hand operational drain cleaning apparatus which is simple in construction, yet durable so as to have a long service life.

SUMMARY

Disclosed herein is a drain cleaning apparatus including a control housing, a release valve member provided on/in the control housing, a coupling for interconnecting the control housing to a terminal discharge member such as through a flexible, tubular hose, and a cartridge housing detachably secured to the control housing and including an interior chamber adapted to receive a selected compressed gas cartridge. In connection with the disclosure, the cartridge housing is selectively adjustable to accommodate cartridges of varying sizes. More particularly, the cartridge housing includes first and second interconnected body portions with an integrated latching assembly. Releasing of the latching assembly enables the second body portion to be shifted relative to the first body portion to selectively vary the volume of the interior chamber. In certain embodiments, the first and second body portions can be selectively latched in either of two positions to accommodate either of two different sized cartridges, e.g., 16 or 20 gram $CO_2$ cartridges.

Additional objects, features and advantages of the present disclosure will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Applicant's hand-held drain cleaner is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

The described features, structures, or characteristics of Applicant's disclosure may be combined in any suitable manner in one or more embodiments. In the following description, numerous specific details are recited to provide a thorough understanding of embodiments of the disclosure. One skilled in the relevant art will recognize, however, that Applicant's disclosure may be practiced without one or more of the specific details, or with other methods, components, materials, and so forth. In other instances, well-known structures, materials, or operations are not shown or described in detail to avoid obscuring aspects of Those skilled in the art will appreciate that Applicants' disclosure is intended to cover alternatives, modifications, and equivalents as may be included within the spirit and scope of Applicant's disclosure as defined by the appended claims and their equivalents as supported by the following disclosure and drawings.

Figure 1:
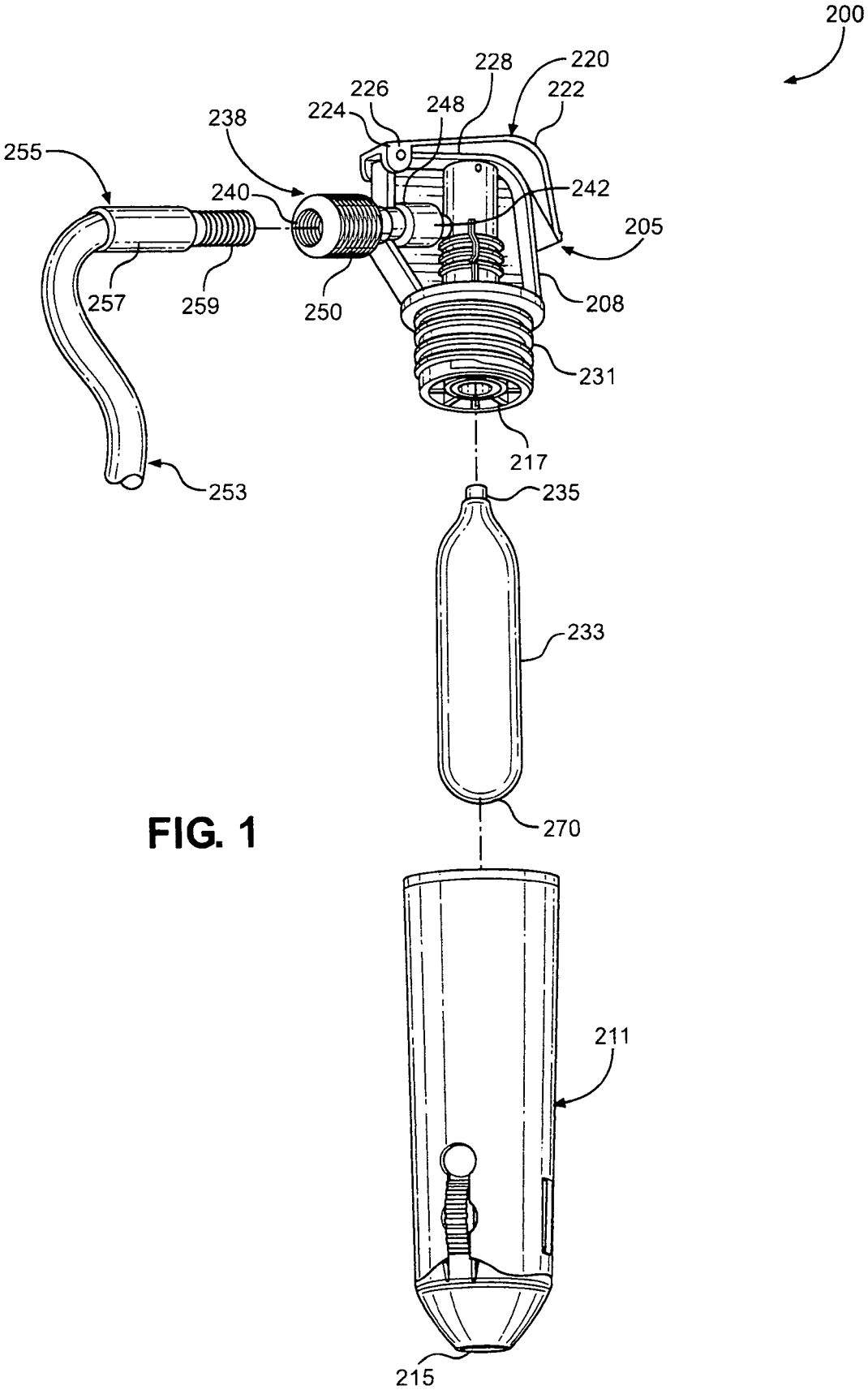
FIG. 1 is a partial exploded view of a drain cleaning apparatus including an adjustable cartridge housing in accordance with a first preferred embodiment of the disclosure.

With initial reference to FIG. 1, the drain cleaning apparatus constructed in accordance with a first preferred embodiment of the disclosure is generally indicated at 200, including a control housing 205, which can be formed of various materials such as metal or plastic, and a cartridge housing 211.

As shown, control housing 205 includes a main body portion 208 formed with an internal fluid passage (not shown) that is generally T-shaped. That fluid passage defines an inlet section 217 and an outlet section 218. A release valve unit, generally indicated at 220, includes a pivotable push button release member 222 having a bifurcated end 224 which rotatably mounts release member 222 to a pair of stub shafts, one of which is indicated at 226, formed as part of main body portion 208.

Release valve unit 220 also includes a linear valve element 228 which projects into the internal fluid passage in order to selectively regulate the fluid interconnection between inlet and outlet sections 217 and 218.

As shown in this exemplary embodiment, control housing 205 is provided with a rotatable coupling 238 which is provided with an internal conduit 240 that is in fluid communication with outlet section 218 of the internal fluid passage. More specifically, coupling 238 includes a first end 242 which extends into a receiving opening (not labeled) formed in main body portion 208.

Coupling 238 is interconnected to main body portion 208 by means of a shaft 248 mating with first end 242 in a manner which prevents longitudinal movement of coupling 238 relative to main body portion 208 while accommodating relative rotation. Coupling 238 preferably includes a second end 250 which defines a knurled knob adapted to be connected to a tubular member 253. In general, tubular member 253 is defined by a flexible tube preferably provided with a terminal discharge member (not shown) for sealing against a conduit drain. In any case, tubular member 253 shown to include a fitting 255, preferably made of brass, that includes a crimped sleeve portion 257 and an externally threaded end 259. End 259 is adapted to be threadably secured to coupling 238 when the added length and flexibility afforded by tubular member 253 is desired.

With this construction, coupling 238 enables flexible tubular member 253 to be more easily maneuvered without developing a kink during use of the drain cleaning apparatus. Again, this can be particularly important given the working environment for this apparatus. On the other hand, a terminal discharge member designed for the conduit to be cleaned could be directly attached to coupling 238 such that flexible tubular member 253 is optional.

Figure 3:
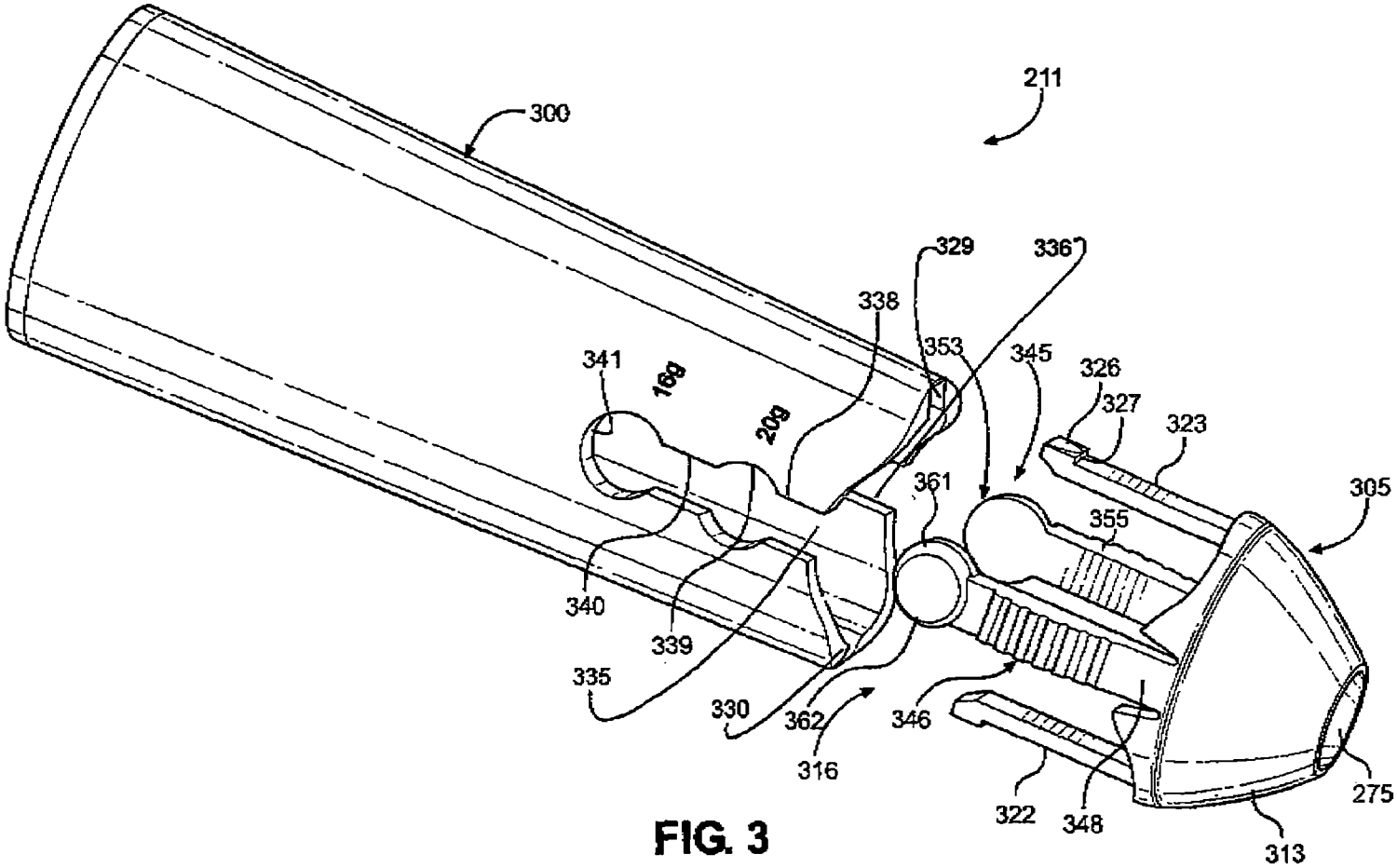
FIG. 3 is a perspective view of the adjustable cartridge housing of FIG. 1 in an exploded or disassembled state.

It should be noted that the internal construction of release valve unit 220 can take various forms in accordance with the present disclosure. For example, the incorporated-by-reference application describes a first release valve unit 5 (FIG. 1) and a second release valve unit 7 (FIG. 3). In certain embodiments, the instant release valve unit 220 may comprise a release valve unit 5 disclosed in the incorporated patent application. In certain embodiments, the instant release valve unit 220 may comprise release a valve unit 7 disclosed in the incorporated patent application.

U.S. Pat. No. 5,803,101 (the '101 Patent) and U.S. Pat. No. 5,996,597 (the '597 Patent), are each incorporated herein by reference. In certain embodiments, the instant release valve unit 220 may comprise the release valve unit 45 disclosed in the 101 Patent. In certain embodiments, the instant release valve unit 220 may comprise the release valve unit 45 disclosed in the '597 Patent.

Referring again to FIG. 1, in accordance with one preferred embodiment, linear valve element 228 is spring biased upward into engagement with push button release member 222 and generally constitutes a spool valve. The lower section of main body portion 208 is externally threaded at 231 for receiving cartridge housing portion 211. More specifically, it should be understood that cartridge housing 211 is adapted to receive a pressurized gas cartridge 233 and is internally threaded at an upper portion (shown best at 234 in FIG. 2) in order to secure cartridge housing 211 to main body portion 208, while simultaneously causing a seal tip 235 of cartridge 233 to extend into inlet section 217 where it is punctured in a manner known in the art as discussed further below. Cartridge 233 is itself preferably made of metal, although polymer materials could also be used, and has a relatively thin outer wall.

As indicated above, cartridge 233 is pressurized, i.e., pre-charged with a gaseous medium. The particular charging pressure could vary in accordance with the disclosure depending on the particular environment of use but, in general, cartridge 233 is pre-charged in the order of 800 psi. Furthermore, cartridge 233 may contain, in addition to the gaseous medium which could be carbon dioxide for example, a drain cleaning or algaecide substance.

Preferably, the leaning or algaecide would be in liquid form and would be atomized so as to be entrained within the gaseous medium in a manner analogous to pre-charged perfume spray containers. The presence of drain cleaning or algaecide substance will assure that the clogged drain is not only cleared but is treated against future occurrences.

Important in connection with the present disclosure is the construction of cartridge housing 211 and the ability of drain cleaning apparatus to be used with multiple, different sized cartridges.

In any event, as indicated, cartridge housing is configured to receive pressurized cartridge 233 and is sized to conveniently fit in the palm of a hand. As shown, cartridge 233 has a rounded bottom portion 270 which becomes generally seated within a reinforced aperture 275 formed in a bottom of cartridge housing 211. Aperture 275 not only enables the presence Or absence of cartridge 233 to be readily determined, but can also aid in centering cartridge 233 in housing 211 and, should any leak develop between cartridge 233 and main body portion 208, aperture 240 will act as a pressure relief opening. Once cartridge 233 is positioned within cartridge housing 211, cartridge housing can be mated with threads 231 of control housing 205.

Tightening of cartridge housing 211 will cause an O-ring (not shown) provided within control housing 205 adjacent inlet section 217 to seal about tapered end 235 and a puncture member (also located within control housing 205 adjacent inlet section 217) to pierce sealed tip 235. At this point, drain cleaning apparatus 200 is ready for use. During use, control housing 205 and cartridge housing 211 are adapted to be readily grasped by and held in one hand for operational purposes. Once properly positioned for use, push button release member 222 need merely be depressed, such as by the thumb of a user, to cause pressurized fluid to flow from cartridge 233 through fluid passage 215, internal conduit 240 and through tubular member 253.

Figure 2:
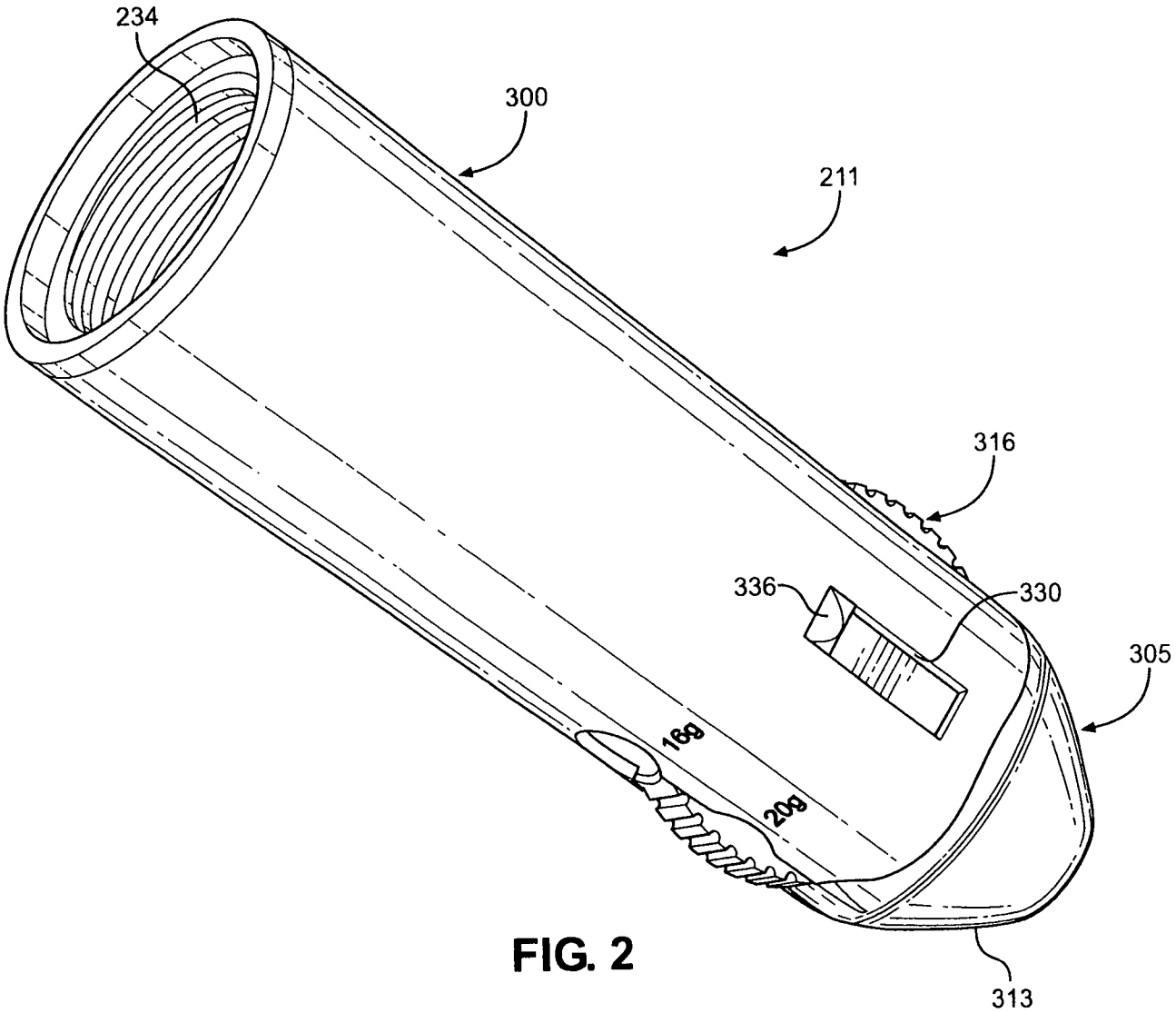
FIG. 2 is a perspective view of the adjustable cartridge housing of FIG. 1 in an assembled state.

Referring now to FIGS. 2 and 3, cartridge housing 211 includes a first body portion 300 and a second body portion 305. In this embodiment, first body portion 300 is generally takes the form of a cylinder which is open at both ends, with internal threads 234 being present at one end. On the other hand, second body portion 305 has a somewhat conical or tapered end 313 leading to aperture 275. The length of cartridge housing 211 is adjustable in accordance with the disclosure, with first and second body portions 300 and 305 being retained in one of multiple in-use positions through a latch assembly generally indicated at 316. In the exemplary embodiment shown, latch assembly 316 includes a pair of clip members 322 and 323 cantilevered at spaced circumferential portions of second body portion 305, wherein each clip member 322, 323 includes a tapered terminal end 326 formed with an undercut 327.

Each terminal end 326 is configured to be snap-fittingly and slidably received in a respective elongated opening 329, 330 formed in first body portion 300. In general, clip members 322 and 323 function to interconnect second body portion 305 to first body portion 300, while also guiding second body portion 305 for linear movement relative to first body portion 300. The extent of linear movement is governed by the length of the elongated openings 329 and 330, in cooperation with each terminal end 326.

At positions angularly offset from elongated openings 329 and 330, first body portion 300 is also provided with a pair of elongated channels 335 and 336. In the embodiment shown, elongated openings 329, 330 and elongated channels 335, 336 alternate and are substantially equally spaced about a lower circumference of first body portion 300. Each elongated channel 335, 336 includes an open-ended, first narrowed portion 338 leading to a first enlarged portion 339, then to a second narrowed portion 340 and finally to a second enlarged portion 341. Elongated channels 335 and 336 are configured to receive a respective latch arm 345, 346 extending from second body portion 305. Each latch arm 345, 346 includes a first end 348 extending from second body portion 305, an enlarged head 353 remote from first end 348, and an intermediate body section 355 which is shown to be bowed or arcuate while including undulations 357. In addition, each head 353 is shown formed with a first diametric base portion 361 and a second, reduced diametric face or projecting portion 362 which projects from base portion 361.

In certain embodiments, each latch arm 345, 346 are cantilevered from second body portion 305. In a preferred form wherein each of first and second body portions 300 and 305 are molded of plastic, dip members 322, 323 and latch arms 345, 346 are secured to second body portion 305 through an integral molding process. However, other materials and constructions, including various other latching arrangements overall, could readily be employed. In any case, each intermediate body section 355 is sized to slide within narrow portions 338 and 340 of a respective elongated channel 335, 336, while only the second, reduced diametric face portion 362 of each enlarged head 353 can fit into a select one of enlarged portions 339 and 341. In this fashion, a user of drain cleaning apparatus 200 can selectively adjust the overall size or length of cartridge housing 211 by manually pinching intermediate body sections 355 toward one another in order to deflect the second, reduced diametric face portions 362 of the opposing enlarged heads 353 out of the enlarged portions 339 and 341 in order to shift second body portion 305 relative to first body portion 300 to either extend or retract the overall length of cartridge housing 211. Once the pinching, force is removed from intermediate body sections 355, latch arms 345 and 346 shift outward through an inherent biasing effect until reduced diametric face portions 362 of enlarged heads 353 are again received in a select set of enlarged portions 339, 341 of elongated channels 335 and 336.

The ability to selectively adjust the length and, correspondingly, the internal volume of cartridge housing 211 advantageously enables drain cleaning apparatus 200 to be readily used with different sized pressurized cartridges 233. In the preferred embodiment shown, cartridge housing 211 can be selectively latched in one of two positions, enabling both 16 gram and 20 gram $CO_2$ cartridges 233 to be readily utilized. The ability to employ different sized cartridges can be quite important depending on the service to be performed. For instance, a certain amount of pressurized fluid may be need to clear a drain, but that amount of fluid/pressure may not be obtainable in a smaller cartridge if one or more additives, such as an algaecide, is also employed. With the disclosure, cartridge housing 211 can be readily reconfigured to accommodate the required cartridge size.

Figure 4:
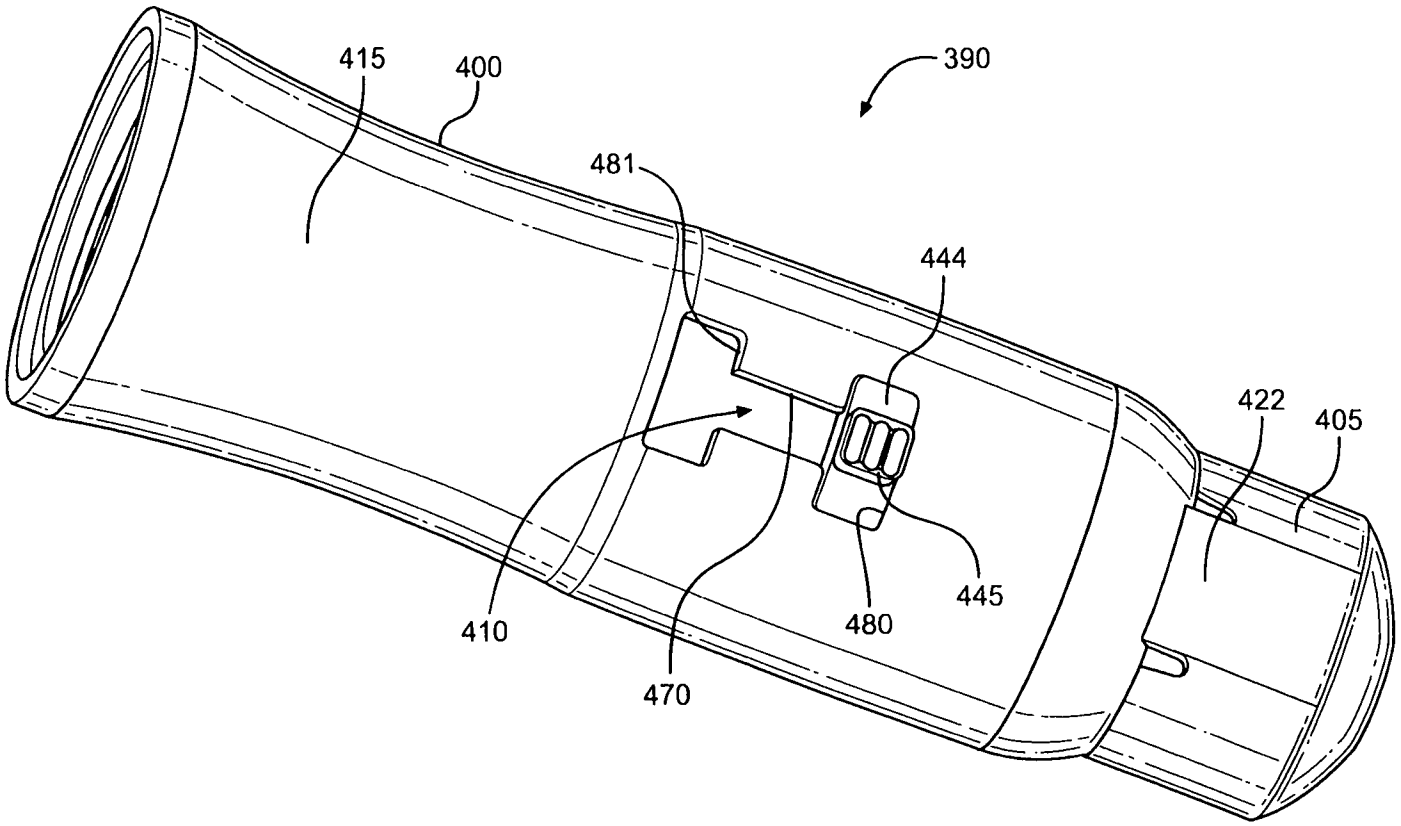
FIG. 4 is a perspective view of an assembled, adjustable cartridge housing constructed in accordance with another embodiment of the disclosure.
Figure 5:
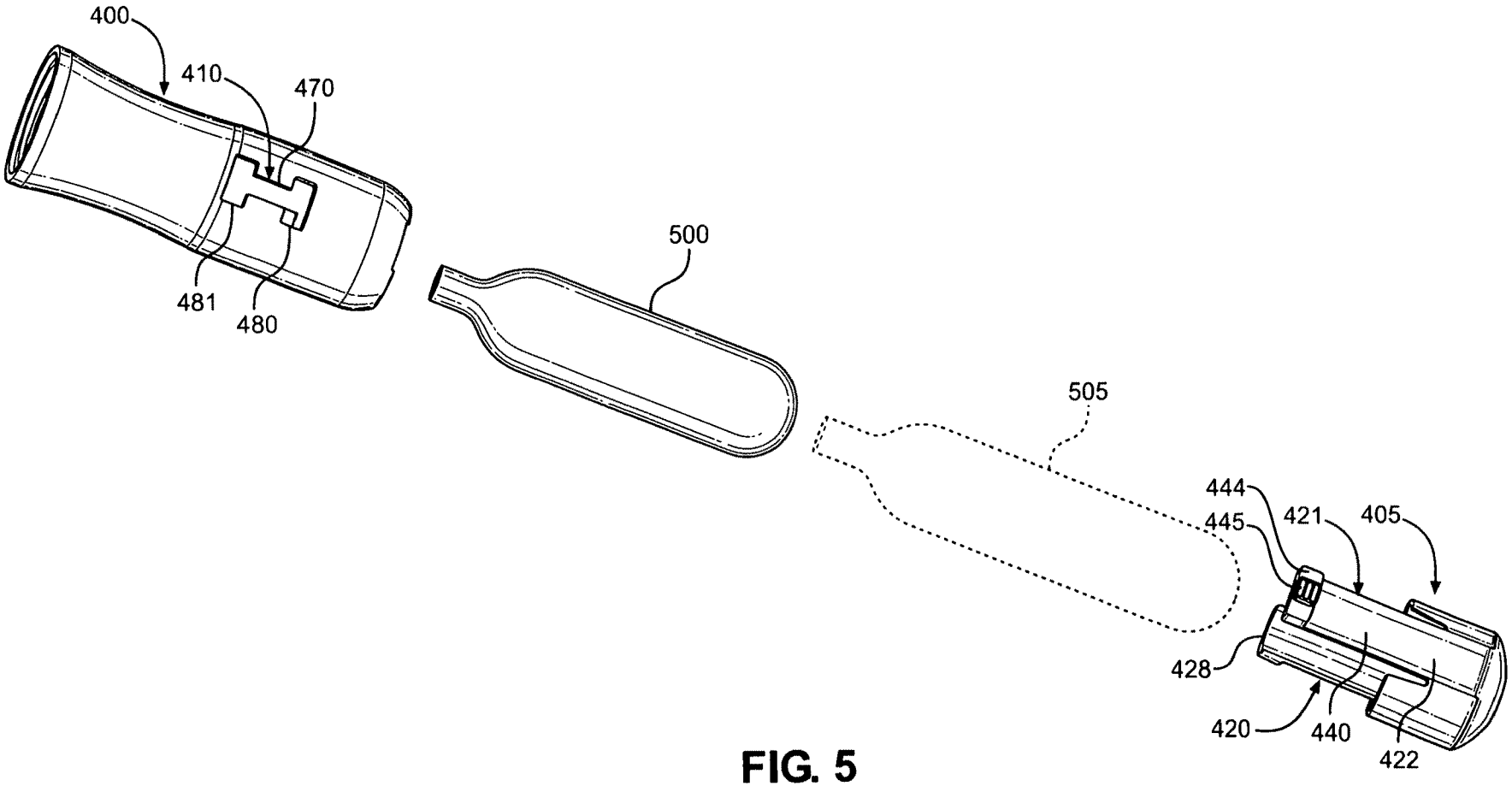
FIG. 5 is an exploded view of the adjustable cartridge housing of FIG. 4 shown for use with differing sized cartridges.

FIGS. 4 and 5 another embodiment of the disclosure wherein an adjust cartridge housing 390 includes a first body portion 400 and a second body portion 405 which can be secured together at select positions through a latch assembly 410. Again, first body portion 400 has open ends and is generally cylindrical, although a section of the first body portion 400 could be tapered, such as shown at 415, such as for grip feel. In any case, in this embodiment, latch assembly 410 is shown to include two opposing, cantilevered latch arms 420 and 421 each having a first end 422 extending from second body portion 405, an enlarged head 428 at a remote, second end, and an intermediate body section 440. Each enlarged head 428 includes side projecting portions one of which is labeled 444 and a central projecting portion 445 shown with undulations. With this construction, part of each enlarged head 428 defines a base or portion with a first thickness or diameter, while projecting portion 445 establishes another portion of the enlarged head 428 which is comparatively smaller in size, thickness or diameter.

For each latch arm 420, 421 latch assembly 410 also includes cooperating structure on first body portion 400. As shown, first body portion 400 is formed with opposing channels, each including a central narrow channel portion 470 leading to spaced laterally or circumferentially expanded channel, portions 480 and 481. When second body portion 405 is assembled to first body portion 400, latch arms 420 and 421 are initially deflected toward one another until the enlarged head 428 of each latch arm 420, 421 expands into a respective channel portion 480 or 481.

Once assembled, the overall length of cartridge housing 390 can be readily adjusted by manually depressing central projecting portion 445 until side projecting portions 444 are recessed, whereupon second body portion 405 can be slid relative to first body portion 400 further into or pulled thither from within first body portion 400, with side projecting portions 444 reaching a corresponding one of expanded channel portions 480 and 481. Releasing projection portion 445 will then put cartridge housing 390 in an in-use position with side projecting portions 444 preventing further sliding movement. In this fashion, as with the embodiment described above, cartridge housing 390 can be readily reconfigured to accommodate the required cartridge size, with FIG. 5 actually depicting smaller and larger sized cartridges, e.g., 16 g and 20 g cartridges 500 and 505, respectively.

As those skilled in the art will appreciate, other latching positions can readily be configured having differing lengths to accommodate additional sized cartridges.

As indicated above, there are various different cartridge housing constructions which can be established to achieve the objects of the disclosure. In another potential embodiment (not illustrated), the first or upper body cartridge housing body portion could be internally threaded, while the second or lower cartridge housing body portion has a central body with first and second opposing externally threaded end portions having different lengths. With such an arrangement, the longer first threaded end portion could be attached to the first body portion to accommodate a smaller cartridge, or the lower cartridge housing body portion could be reversed such that the shorter, second threaded end portion is attached to the first body portion to accommodate a longer cartridge. In either case, the tip of the cartridge (large or small) would project out of the housing the same amount.

Certainly, the external/internal threading arrangement could be reversed and even other arrangements to selectively establish varying volume cartridge receiving chambers could be employed which enable the cartridge housing to be readily reconfigured to accommodate the required cartridge size without departing from the disclosure.

Figure 6A:
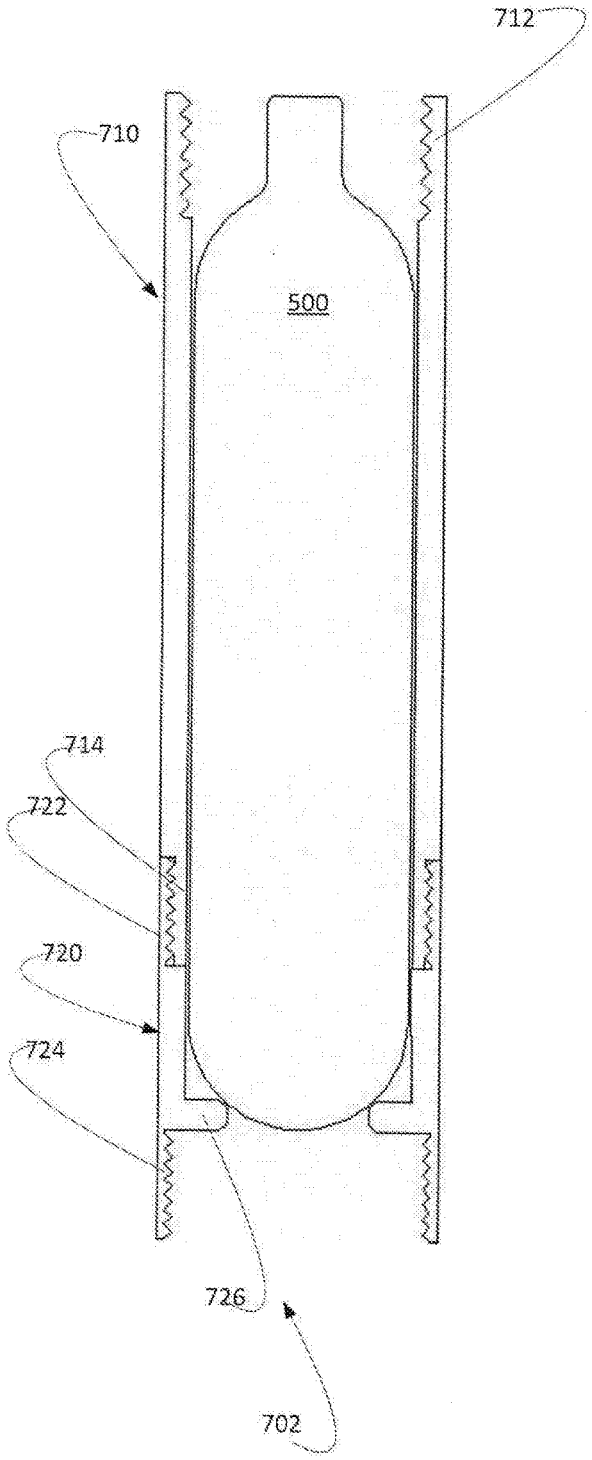
FIG. 6A illustrates a first configuration of another embodiment of Applicants' cartridge housing.
Figure 6B:
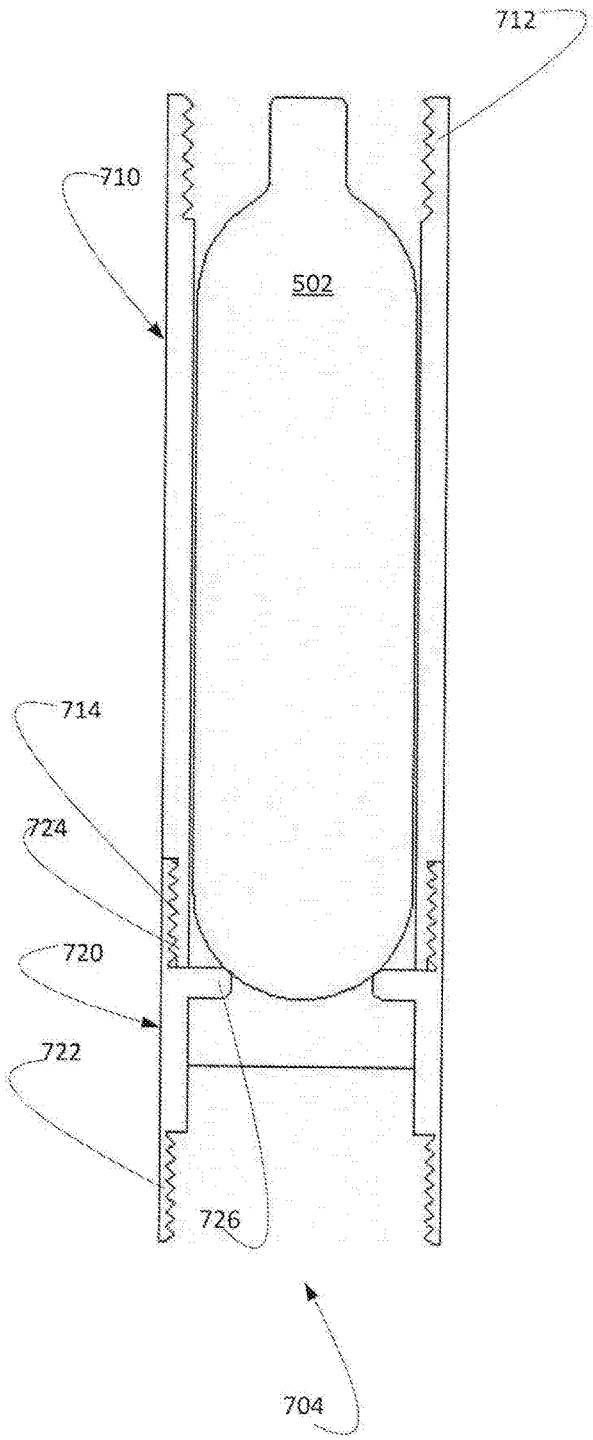
FIG. 6B illustrates a second configuration of the cartridge housing of FIG. 6A.

For example, refer now to FIGS. 6A and 6B. Both cartridge housing 702 and cartridge housing 704 comprise a first cylindrical, tubular assembly 710 in combination with a second cylindrical, tubular assembly 720.

First cylindrical, tubular assembly 710 comprises threaded ends 712 and 714. Second cylindrical, tubular assembly 7704 comprises threaded ends 722 and 724, in combination with an internal lip 726 which acts as a floor for an enclosed compressed gas cartridge. Internal lip 14 is asymmetrically disposed between threaded end 714 and threaded end 724. In the illustrated embodiments of FIGS. 6A and 6B, internal lip 726 is disposed closer to threaded end 724 than to threaded end 714. This being the case, by selecting which threaded end of second cylindrical, tubular assembly 720 is attached threaded end 714 of first cylindrical, tubular assembly 710, the internal enclosed volume can be selected between a greater internal volume, such as housing 702, or a lesser internal volume, such as housing 704.

More specifically, in cartridge housing 702 threaded end 722 of the second cylindrical, tubular assembly 720 is intermeshed with threaded end 714 of first cylindrical, tubular assembly 710. As illustrated in FIG. 6A, cartridge housing 702 can accommodate a longer compressed gas cartridge than can cartridge assembly 704. In cartridge housing 702, threaded end 722 of the second cylindrical, tubular assembly 720 is intermeshed with threaded end 714 of first cylindrical, tubular assembly 710. As illustrated ire FIG. 6A, cartridge housing 702 can accommodate a longer compressed gas cartridge than can cartridge assembly 704.

In contrast, in cartridge housing 704 threaded end 724 of the second cylindrical, tubular assembly 720 is intermeshed with threaded end 714 of first cylindrical, tubular assembly 710. As illustrated in FIG. 6B, cartridge housing 704 can only accommodate a shorter compressed gas cartridge than can cartridge assembly 702.

While the preferred embodiments of the present disclosure have been illustrated in detail, it should be apparent that modifications and adaptations to those embodiments may occur to one skilled in the art without departing from the scope of Applicant's disclosure.

We claim:

1. A hand-held drain cleaning apparatus, comprising:

a control housing comprising an inlet end and an outlet end; and a cartridge housing having a length;

wherein:

said cartridge housing is releasably attached to said control housing; and said length can be manually adjusted based upon a size of a selected compressed gas cartridge disposed therein;

an upper body portion releasably attached to said control housing; and a lower body portion releasably attached to said upper body portion;

said upper body portion comprises a tubular member having a first end configured to be releasably attached to said control housing;

said upper body portion further comprises an opposing second end configured to be releasably attached to said lower body portion;

said upper body portion comprises a first diameter at said first end;

said lower body portion comprises a second diameter at said second end;

said first diameter is greater than said second diameter;

said upper body portion is formed to include a first plurality of elongated channels formed therethrough;

a first portion of each elongated channel extends to said second end;

said first portion of each elongated channel comprises a first width;

said first portion of each elongated channel extends from said second end upwardly a first distance;

each elongated channel is further formed to include a first circular aperture having a first diameter at said first distance;

said first diameter is greater than said first width;

each elongated channel is further formed to include a second enlarged portion extending therethrough at a second distance;

each elongated channel is further formed to include a second narrow portion, said second narrow portion interconnecting said first aperture and said second aperture said second distance is greater than said first distance;

said second enlarged portion comprises said first diameter;

said second narrow portion comprises said first width;

said lower body portion is formed to comprise a conical end portion with a bottom aperture extending therethrough;

said lower body portion is formed to include a second plurality of latch arms;

each latch arm extends outwardly from said conical end portion;

wherein said second plurality equals said first plurality;

each latch arm comprises a rectangular member formed to comprise said first width;

each rectangular member is attached to and extends outwardly from said conical end portion;

each latch arm further comprises a circular member having said first diameter and attached to said rectangular member.

2. The hand-held drain cleaning apparatus of claim 1, wherein:

said lower body portion can be releasably attached to said upper body portion by inserting a first latch arm disposed on said lower body portion into a first elongated channel formed in said upper body portion;

said lower body portion can be further releasably attached to said upper body portion by inserting a second latch arm disposed on said lower body portion into a second elongated channel formed in said upper body portion.

3. A method to adjust the length of the compressed gas cartridge housing of claim 2, comprising:

providing an upper body portion and a lower body portion which when combined form a compressed gas cartridge housing;

selecting a compressed gas cartridge having a first cartridge length;

disposing said selected compressed gas cartridge into said lower body portion;

inserting each lower body portion latch arm formed to include a distal circular member into a different elongated channel formed in said upper body portion until each circular member is disposed within a different first enlarged portion of a first elongated channel.

4. The hand-held drain cleaning apparatus of claim 3, comprising:

selecting a compressed gas cartridge having a second cartridge length, wherein said second cartridge length is greater than said first cartridge length;

inserting each lower body portion latch arm formed to include a distal circular member into a different elongated channel formed in said upper body portion until each circular member is disposed within a different second enlarged portion of a different elongated channel.

5. The hand-held drain cleaning apparatus of claim 1, wherein:

said upper body portion comprises a first cylindrical, tubular member having a first threaded end and an opposing second threaded end;

said lower body portion comprises a second cylindrical, tubular member having a third threaded end, an opposing fourth threaded end, and an internal lip asymmetrically disposed between said third threaded end and said fourth threaded end, said internal lip being disposed closer in distance to said fourth threaded end;

wherein:

when said second threaded end of said first cylindrical, tubular member is intermeshed with, and thereby releasably attached to, said third threaded end of said second cylindrical, tubular member (720), an a first internal volume is defined;

when said second threaded end of said first cylindrical, tubular member is intermeshed with, and thereby releasably attached to, said fourth threaded end of said second cylindrical, tubular member (720), a second internal volume is defined;

said first internal volume is greater than said second internal volume.

* * * * *